United States Patent [19]

Kreyenbuhl

[11] 4,411,445

[45] Oct. 25, 1983

[54] SKI BINDING TO SECURE A SHOE TO A SKI

[75] Inventor: Armand Kreyenbuhl, Samoens, France

[73] Assignee: Adidas - Fabrique de Chassures de Sport, Landersheim, France

[21] Appl. No.: 273,937

[22] Filed: Jun. 15, 1981

[30] Foreign Application Priority Data

Jun. 13, 1980 [FR] France ..... 80 13271

[51] Int. Cl.[3] ..... A63C 9/00

[52] U.S. Cl. ..... 280/615; 281/45; 292/128

[58] Field of Search ..... 292/128, DIG. 38, 127, 292/219-228, 87; 24/255 SL, 248 B, 248 SA, 252 R, 263 B; 281/45; 280/615

[56] References Cited

U.S. PATENT DOCUMENTS

| | | | |
|---|---|---|---|
| 1,989,988 | 2/1935 | Jones | 308/20 |
| 2,342,146 | 2/1944 | Joyce | 24/252 R X |
| 3,708,844 | 1/1973 | Rawson | 193/35 R X |
| 3,822,905 | 7/1974 | Bell | 292/DIG. 38 X |
| 4,277,864 | 7/1981 | Orson, Sr. | 24/255 SL X |

FOREIGN PATENT DOCUMENTS

| | | | |
|---|---|---|---|
| 2622966 | 5/1976 | Fed. Rep. of Germany | 280/615 |
| 119009 | 3/1970 | Norway | 280/615 |
| 445400 | 4/1936 | United Kingdom | 474/96 |

*Primary Examiner*—Joseph F. Peters, Jr.
*Assistant Examiner*—Michael Mar
*Attorney, Agent, or Firm*—Brisebois & Kruger

[57] ABSTRACT

The invention relates to a device for securing a boot to a ski in which the boot is held by an extension (10) of the sole, a locking device (14) immobilizing this extension in the archplate.

A hook (14) forming part of the archplate includes an elastic extension (18) opposite the tip (15), this extension being in contact with the ski.

8 Claims, 3 Drawing Figures

SKI BINDING TO SECURE A SHOE TO A SKI

The present invention relates to a binding for securing a boot to a ski, especially a touring or cross-country ski, of the type in which the boot is retained by an extension of the sole situated in front of the boot. The extension which is in one piece with the sole, engages in an archplate secured to the ski and which delimits a space which has a shape corresponding in width and height to that of the extension of the sole, the boot being securely fixed to the ski by a locking means which immobilizes the extension of the sole in the archplate, the locking means being constituted of a hook connected to the archplate and pivotable about a horizontal axis perpendicular to the axis of the ski, the tip or catch of the hook being capable of being displaced between a first or locking position in which the tip of the hook is engaged against a shoulder located on the extension of the sole and facing the boot, so as to prevent the extension from disengaging from the archplate and a second or unlocking position in which the tip of the hook is disengaged from the shoulder to permit the separation of the boot from the ski. Such a device is described U.S. application Ser. No. 796,239 now U.S. Pat. No. 4,365,821.

The binding according to the invention is characterized by the fact that the hook comprises a flexible extension on the side opposite the tip or catch, with respect to its pivotal axis, the end of this extension being in contact with the ski.

The hook and its extension are advantageously made in a single piece of a molded plastic material.

Preferably, the hook and its extension have a width essentially equal to that of the archplate in which the extension of the sole engages.

In one preferred embodiment, the locking means and its extension have a rounded exterior shape to ensure better sliding of the fastening device through the snow.

Moreover, the fact that the extension according to the invention comes into contact with the ski prevents the snow from accumulating in the pivot of the locking means and in the front of the archplate.

In order to make the invention better understood, there will now be described by way of illustration and with no limiting character one embodiment, taken as an example, and shown on the attached drawings.

Figure 1:
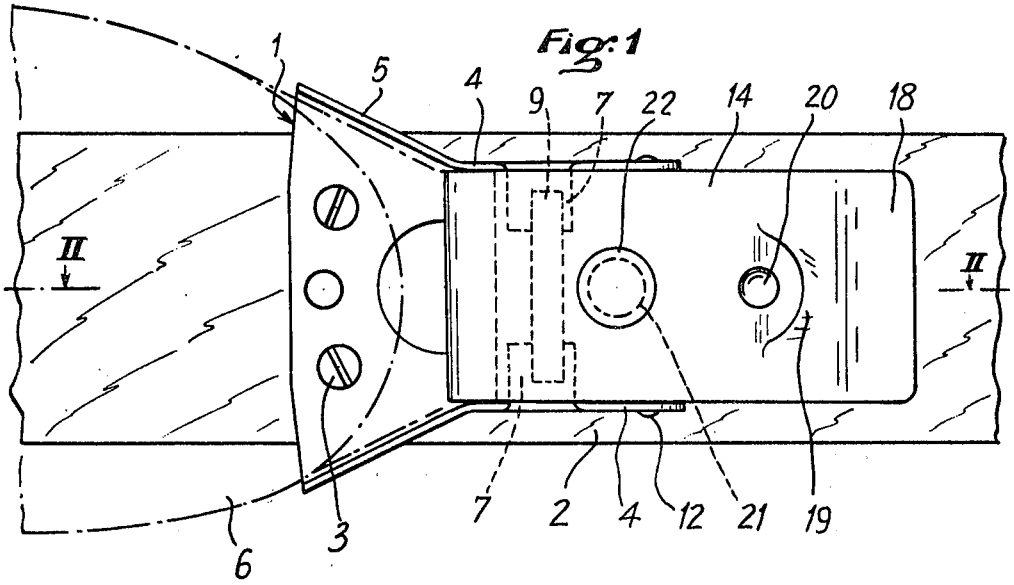
FIG. 1 is a top view of the binding according to the invention.

The drawings also show assembly 1 which accommodates or houses the front part of the boot. This assembly is fastened on ski 2 by screws 3.

Assembly 1 comprises in a known manner two vertical sides 4 extended by diverging flanges or wings 5 between which can enter the front end of the boot 6 shown in dot-dash lines.

Each vertical side 4 comprises at its upper part a horizontal part 7 on which is welded a cross-bar 9 which, with vertical part 4, constitutes the archplate into which the front extension 10 of the sole of the boot can be placed.

The lateral sides 4 of the archplate comprise in addition lugs 11 with openings for mounting a pivot axle 12.

A hook 14 is mounted on pivot axle 12 by means of ears 13, this hook having on the side toward the boot a catch or tip 15 capable of engaging against a shoulder 17 made in extension 10 of the sole of boot 6. When catch 15 of hook 14 is brought against shoulder 17, it prevents any backward displacement or withdrawal of boot 6.

Hook 14 comprises at its other end a flexible extension 18 which is in contact with the upper surface of the ski. This hook and its flexible extension 18 are of a width essentially equal to the distance separating vertical sides 4, and are of rounded exterior shape.

A ridge 19 basically circular in shape defines a hollow or depression in the bottom of which is located a recess 20 on the extension of the hook, and a finger 30 is provided projecting from the lower surface of the hook.

Finally, hook 14 has an opening 21 providing access to screw 3 located immediately below it. A plug 22 ensures closing the opening 21 after this screw has been put in place.

In the embodiment shown on the drawings, hook 14, its catch or tip 15, and its extension 18 are made in a single piece from a molded plastic material.

A helical spring 23 is disposed on the pivot axle 12 of the hook with one of its arms pressing on the front part of the hook and its other arm pressing on a part connected to the archplate.

Figure 2:
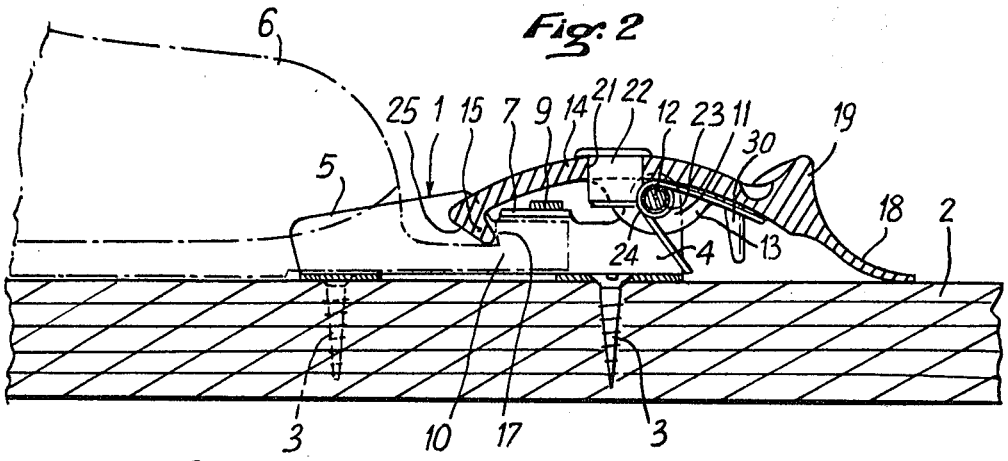
FIG. 2 is a view in section taken along the line II—II of FIG. 1, in which the hook is in its locking position.

When the binding according to the invention is mounted on ski 2, the end of extension 18 is in contact with the upper surface of the ski, which tends to hold hook 14 in the locked position shown on FIG. 2. Helical spring 24 also tends to bring hook 14 back into this position.

Figure 3:
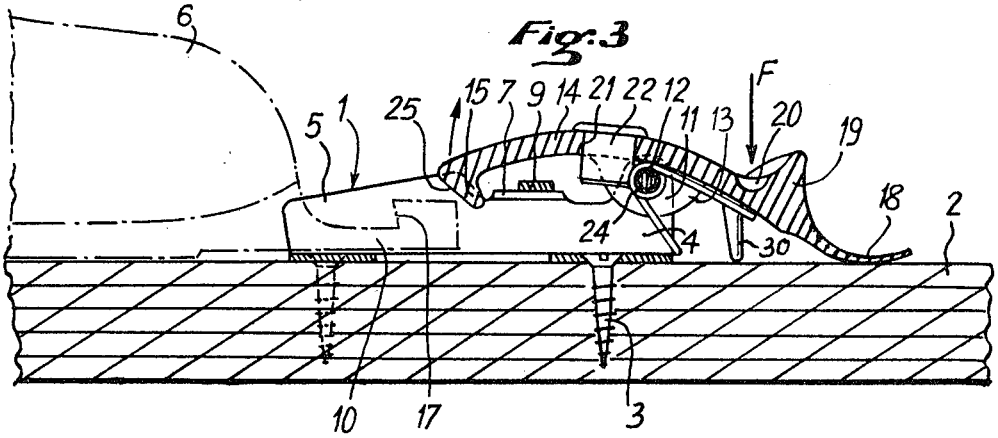
FIG. 3 is a view in section similar to FIG. 2, in which the hook is in its unlocking position.

If extension 10 of the sole of boot 6 is then engaged forwardly in the archplate, by pressing on lower face 25 of tip 15, it tilts hook 14 to the position shown on FIG. 3 against the elastic action of extension 18 and against the action of helical spring 24. When boot 6 is engaged entirely, tip 15 of hook 14 comes back to its initial locking position against shoulder 17, while the end of extension 10 is located under the archplate.

To withdraw the boot from the binding, pressure is exerted in the direction of arrow F, for example by means of the point of a ski pole held in recess 20 by ridge 19. The effect of this pressure is to flex extension 18 of hook 14 and to compress helical spring 24 by pivoting hook 14 to its position shown on FIG. 3. Boot 6 may then be drawn backwards and disengaged from the binding.

In this pivoting movement of hook 14, finger 30 serves however the function of a stop by coming into contact with the upper surface of ski 2, thus preventing too great a displacement of the hook.

Consequently it will be noted that the improvement according to the invention has two essential advantages.

On the one hand, extension 18 because of its flexibility serves to complement the action of spring 24 to hold hook 14 in its locking position. Moreover, this extension 18, since it is permanently in contact with the upper surface of ski 2, gives the device a streamlined form which ensures better penetration through the snow. In particular, because of its width, it prevents accumulation of snow at the front of the binding.

It is to be understood that the embodiment described above is not presented as of limiting character and may undergo any desirable modifications without departing from the scope of the invention.

In particular, hook 14 which has been described as molded in a single piece of plastic material with its catch 15 and its extension 18 may be made in a different manner.

I claim:

1. In a ski binding for fastening a boot to a ski, especially a cross-country ski or touring ski, said binding being of the type in which the boot is secured to the ski by an extension of the sole located at the front of the boot which engages in an archplate connected to the ski which delimits a space whose shape corresponds in width and height to that of the extension of the sole, locking means for locking the sole extension in the archplate against rearward withdrawal of the extension from the archplate, said locking means comprising, a latch, means connecting said latch to said archplate for pivotal movement about a horizontal axis transverse to the length of the ski, from a locking position in which the latch engages a cooperating surface of the sole extension to prevent rearward withdrawal of the sole extension from the archplate, to an unlocking position in which the latch is disengaged from the sole extension and can be withdrawn from the archplate, said latch comprising a front portion having a flexible extension which engages the ski at a location in front of the horizontal axis of pivotal movement of the latch in both said locking and unlocking positions of the latch, said latch and its front portion having a streamlined exterior profile axially of the ski to minimize accumulation of snow at the front of the binding, and wherein pivoting said locking means from said locking position to said unlocking position will flex said flexible extension.

2. Binding according to claim 1 wherein the latch, and its front portion and flexible extension comprise, a single piece of molded plastic material.

3. Binding according to claim 1 wherein the latch and its front portion and flexible extension have a width essentially equal to that of the rest of the binding.

4. In a ski binding for fastening a boot to a ski especially a cross-country or touring ski, said binding being of the type in which the boot is secured to the ski by an extension of the sole located at the front of the boot which engages in an archplate connected to the ski which delimits a space whose shape corresponds in width and height to that of the extension of the sole introduced in said archplate by engagement of a shoulder on said extension of the sole, said locking means comprising, a latch, means connecting said latch to said archplate for pivotal movement about a horizontal axis transverse to the length of the ski, from a locking position in which the latch engages said shoulder of the extension to the sole to prevent rearward withdrawal of the extension from the archplate, to an unlocking position in which the latch is disengaged from said shoulder of the sole extension, so that the sole extension can be withdrawn from the archplate, said latch having an upper convex surface of generally arcuate shape and of essentially the same width as the rest of the binding, said upper surface being extended by a flexible front extension of approximately the same width as the upper surface, which engages the ski at a location in front of said horizontal axis of pivotal movement of the latch, in at least said locking position, which tends to swing the latch into said locking position and wherein downward pressure against said upper surface at a location in front of said horizontal axis will cause said latch to disengage from said extension, and will flex said flexible extension because of its engagement with the ski.

5. Binding according to claim 4 in which the upper convex surface of the latch comprises a recess in the vicinity of the flexible extension for receiving a ski pole in order to swing the latch to the unlocking position.

6. Binding according to any one of claims 1 to 3, or 4 further comprising spring means for urging said latch toward said locked position.

7. A ski binding according to claim 1 or claim 4 wherein said flexible extension comprises an elastic extension.

8. A ski binding according to claim 1 or claim 4 wherein said flexible extension is in constant engagement with the ski.

* * * * *